United States Patent [19]

Matone, Jr. et al.

[11] Patent Number: 4,758,712

[45] Date of Patent: Jul. 19, 1988

[54] PROTECTIVE KEYBOARD ENCLOSURE ASSEMBLY

[76] Inventors: Charles J. Matone, Jr., R.D. #9, Box 602A, Greensburg, Pa. 15601; Dwayne W. Altman, 209 Belmont St., North Huntingdon, Pa. 15642

[21] Appl. No.: 89,982

[22] Filed: Aug. 27, 1987

[51] Int. Cl.[4] ..... G06C 7/02; H01H 9/04

[52] U.S. Cl. ..... 235/145 R; 235/1 D; 200/302.2; 312/208

[58] Field of Search ..... 235/1 D, 145 R; 200/5 R, 5 A, 301, 302.1, 302.2, 303; 312/208, 284

[56] References Cited

U.S. PATENT DOCUMENTS

| | | | |
|---|---|---|---|
| 2,492,262 | 12/1949 | Boyden et al. | 235/1 D |
| 3,890,480 | 6/1975 | Berling et al. | 200/302.2 |
| 4,066,850 | 1/1978 | Heys, Jr. | 235/145 R X |
| 4,326,193 | 4/1982 | Markley et al. | 235/145 R X |
| 4,396,830 | 8/1983 | Isozaki et al. | 235/145 R |
| 4,449,763 | 5/1984 | Barnett | 312/208 |
| 4,546,947 | 10/1985 | Gesten | 312/284 X |

*Primary Examiner*—B. R. Fuller

*Attorney, Agent, or Firm*—H. Keith Hauger

[57] ABSTRACT

A protective keyboard enclosure assembly consisting of an upper section that mounts over a lower section and conforms to the size and shape of an electronic keyboard it houses and shields. The upper section allows a keyboard operator to push keys through a transparent, flexible, durable membrane which is readily interchangeable. The keyboard enclosure assembly protects this very sensitive electronic keyboard from any kind of harmful elements and potentially dirty hands and fingers of an operator all of which especially prevail in an industrial or manufacturing plant.

9 Claims, 2 Drawing Sheets

47
48
46
40
47

90
88
86
82
84
54
50
88

60
30
22
42
20
24

PROTECTIVE KEYBOARD ENCLOSURE ASSEMBLY

BACKGROUND OF THE INVENTION

1. Field Of The Invention

This invention relates generally to a protective enclosure for computer, word processor and other similar keyboards.

2. Description Of The Prior Art

Industry and manufacturing in America and abroad have emerged with the use of electronically and computer controlled systems. Personal and other types of computers utilize electronic keyboards for punching in data and information which have a variety of uses including controlling equipment, word processing, management control, computations and production of information and related uses. This trend of plant automation demanded a means of protecting the electronic keyboards that are linked to the computer systems because said keyboards are extremely sensitive to harsh industrial and plant environments which subject them to dust particles, liquids and gases.

One previous cover, Berling U.S. Pat. No. 3,890,480, involves a means of hermetically sealing the keys themselves with a shield or grid membrane punched and corresponding to shaft shoulders which lead to the keys. Berling allows the keys to operate and yet create a means of protection from the aforesaid elements. A second type of cover is shown in Barnett U.S. Pat. No. 4,449,763. This cover is in the form of a hard transparent hood which fits over the keyboard section of a business machine and has one side open to allow an operator's hand to move about the keys. Another concept is shown and explored by Gesten U.S. Pat. No. 4,546,947, which operates as a cover and copy holder. It consists of a hard, clear cover that scans over the keyboard and is hinged at the rear thereof to pivot to a vertical position and act in its second capacity as a copy holder. The keyboard is not protected during the operation from dirty fingers or other potentially damaging substances. Industry now demands that electronic keyboards be protected by covers that allow operation of same simultaneously to prevent wasteful discarding of keyboards that are continuously damaged by harmful elements around and about the manufacturing process.

SUMMARY OF THE INVENTION

It is, therefore, an object of the present invention to protect electronic keyboards from dust, dirt, debris, liquids, metal chips, gases and other harmful substances as may be incurred in the manufacturing shop and factory atmospheres.

It is the further object of this invention to completely seal electronic keyboards from dust, dirt, debris, liquids, metal chips, gases and other harmful substances.

It is the further object of the invention to provide a convenient and inexpensive means to access the electronic keyboard when necessary or desired, yet still protect it as above described.

It is the further object of the invention to allow the operator to freely operate the electronic keyboard without exposing same to greasy or dirty fingers and other like harmful elements in and about the industrial atmosphere.

It is the further object of the invention to provide a durable and inexpensive means of protecting the electronic keyboard from accidental mishaps, falling objects, traumatic blows or spilling liquids, all of which would cause serious damage thereto.

It is the further object of the invention to use same with any size and type of personal computer or other electronic keyboard, regardless of variations in size and number of keys.

It is the further object of the invention that a transparent viewing window utilized to push the keys on the keyboard is readily replaced in the event of wear, damage or puncture.

More specifically, the present invention is a keyboard enclosure assembly for protection of a keyboard connected to a system including computer, display monitor, and related equipment, comprising an upper section of enclosure assembly having a thickness with top and underside surfaces and an opening extending through said thickness from said top to said underside surface, said top surface being constructed such that said opening forms a viewing window and having sidewalls extending from said underside surface; a lower section of enclosure assembly having a thickness with top and underside surfaces suitable for holding said keyboard at rest on said top surface and having sidewalls extending from said top surface such that said upper section of enclosure assembly may be mounted over said lower section of enclosure assembly; a transparent, flexible membrane positioned in said opening of said upper section of enclosure assembly permitting an operator to view and press keys located in said keyboard; a holding means for securing said transparent, flexible membrane to said upper section of enclosure assembly; a sealing means between said upper section of enclosure assembly and said lower section of enclosure assembly; a first fastening means for securing said transparent, flexible membrane between said holding means and said upper section of enclosure assembly; a second fastening means for securing said upper section of enclosure assembly to said lower section of enclosure assembly.

These objects, as well as other objects and advantages of the present invention, will become apparent from the following description, in reference to the illustrations appended hereto.

BRIEF DESCRIPTION OF THE DRAWINGS

For a better understanding of the invention, reference may be had to the accompanying drawings, in which.

DESCRIPTION OF PREFERRED EMBODIMENTS

Figure 1:
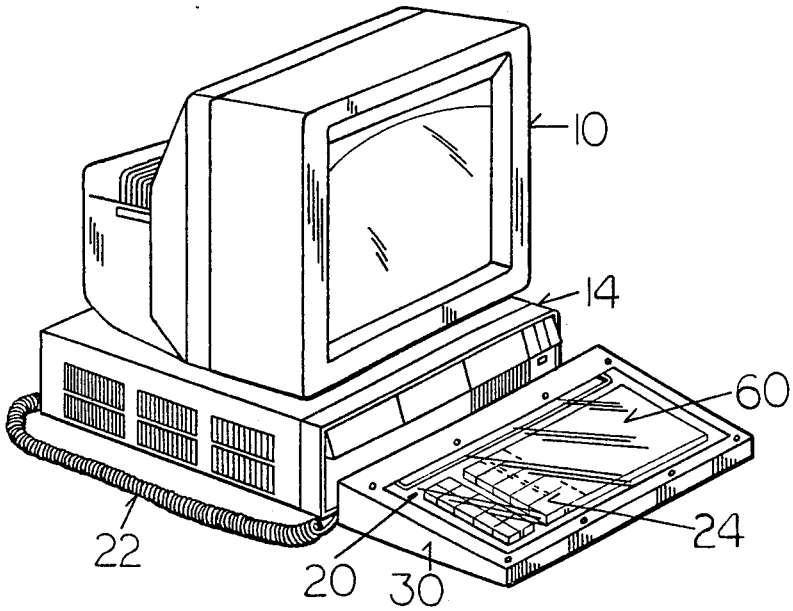
FIG. 1 perspective view of an electronic computer connected to an electronic keyboard enclosed in a protective keyboard enclosure assembly and showing a CRT (Cathode-Ray Tube) as part of the system.

Referring to the drawings, FIG. 1 is a perspective view of an electronic computer 14, CRT in the form of a display monitor 10, electronic keyboard 20, having keys 24 and being connected by cable 22 to electronic computer 14. Said electronic keyboard 20 is contained in a protective keyboard enclosure assembly 30 allowing said keys 24 to be visible and operable through a transparent, flexible membrane 60. Generally, keyboard 20 is wedge-shaped when viewed at its side and keyboard enclosure assembly 30 conforms to this wedge shape. The system shown is often referred to as a PC (Personal Computer) and may include a printer which is not shown. The electronic keyboard 20 is used with other computer systems which are not shown. The protective keyboard enclosure assembly 30 is designed to prevent dust, dirt, spilled drinks, liquids, gases and other destructive elements and substances from entering the electronic keyboard 20 which contains therein sensitive circuits (not pictured) housed and contained within the keyboard housing 26 as shown in FIG. 3.

Figure 2:
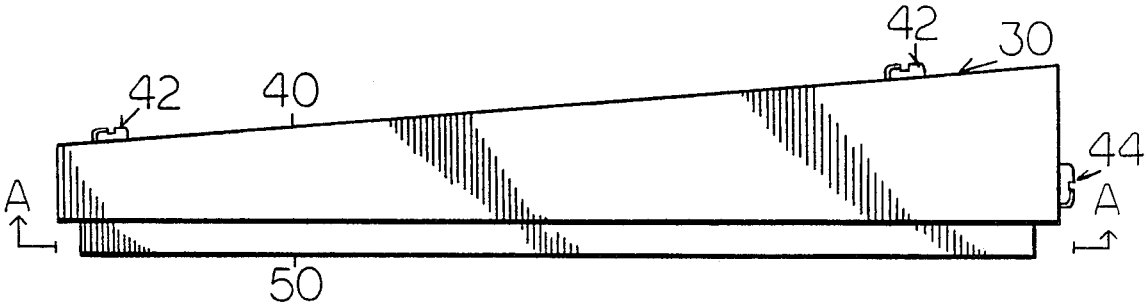
FIG. 2 represents a side elevation view of a protective keyboard enclosure assembly in the closed and sealed position.

FIG. 2 shows a protective keyboard enclosure assembly 30 in a closed, sealed position wherein the upper section of enclosure assembly 40 fits and slips over a lower section of enclosure assembly 50 which houses electronic keyboard 20 therein. Said upper section of enclosure assembly 40 is fastened to said lower section of enclosure assembly 50 by a series of fasteners 44. Said protective keyboard enclosure assembly 30 may be constructed from a variety of materials including steel, stainless steel, aluminum, and plastic. However, the best mode for industrial use is aluminum because of its light weight, durability and strength. The protective keyboard enclosure assembly 30 is designed to meet NEMA (National Electronic Manufacturers Association) standards and specifications. Fasteners 42 are utilized to position and contain flexible membrane 60 as will be more fully described and set forth herein.

Figure 3:
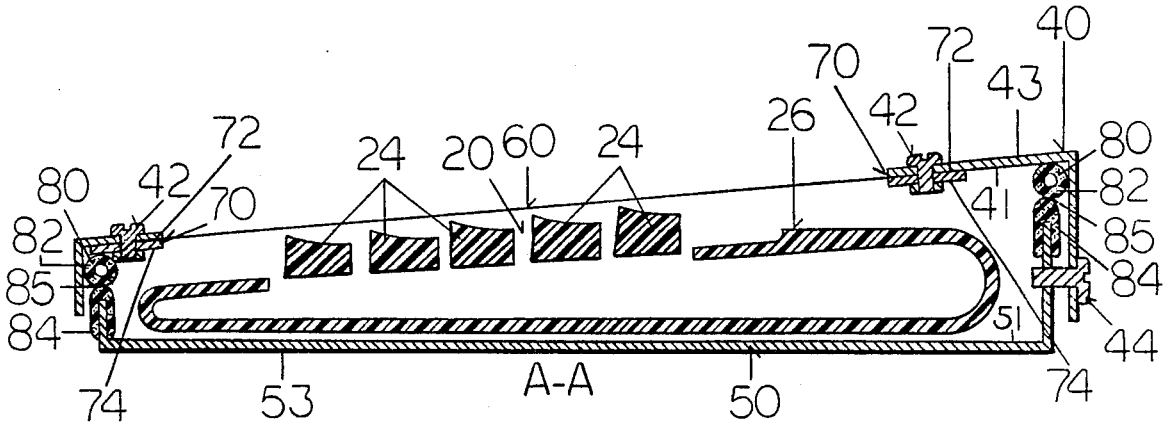
FIG. 3 represents a side elevation view of the keyboard enclosure assembly containing an electronic keyboard taken along line A—A in FIG. 2.

FIG. 3 is a cross-sectional view of protective keyboard enclosure assembly 30 containing electronic keyboard 20. Transparent, flexible membrane 60 is mounted between clamp ring 70 and the underside surface 41 of upper section of enclosure assembly 40 by fasteners 42 to a desired tension on transparent, flexible membrane 60 allowing for proper flexibility for operation of keys 24. Upper section of keyboard enclosure 40 has top surface 43 and clamp ring 70 has top surface 72 and underside surface 74. Lower section of keyboard enclosure 50 has top surface 51 and underside surface 53. Important features of transparent, flexible membrane 60 include its flexibility for operation, interchangeability, clear viewing and protection of electronic keyboard 20. Transparent, flexible membrane 60 is preferably made from PVC plastic vinyl which is inexpensive and easily replaced.

Many industrial atmospheres contain micro-particles which can settle into sensitive plant equipment and result in serious damage thereto. Protective keyboard enclosure assembly 30 is designed with seal 80 mounted on the perimeter of lower section of enclosure assembly 50 where same meets upper section of enclosure assembly 40 to prevent these micro-particles from disturbing electronic keyboard 20. Seal 80 consists of bubble gasket 82, being of circular or tube shape cross section and U-shaped gasket 84, which is mounted as aforesaid to lower section of enclosure assembly 50. Seal 80 is extruded or fabricated to the cross-sectional shape shown in FIG. 3 where bubble gasket 82 is located above U-shaped gasket 84 at contact point 85. Seal 80 is preferably constructed of a durable and flexible rubber which is slit at 86, being located on the center line of slot 54 for sealing around cable 22. Protective keyboard enclosure assembly 30 acts to hermetically seal and protect electronic keyboard 20 as aforementioned and adds additional protection of electronic keyboard housing 26 often constructed from plastic and being subject to damage from dirt and blunt forces like metal tools.

Upper section of enclosure assembly 40 has slot 46 located on rear surface 48 which allows cable 22 to exit from protective keyboard enclosure assembly 30 and is shown in the sealed position in FIGS. 1, 2, and 3. Fasteners 44 slide into slots 47 on surface 48 to secure upper section of enclosure assembly 40 to lower section of enclosure assembly 50.

Figures 4, 5, 6:
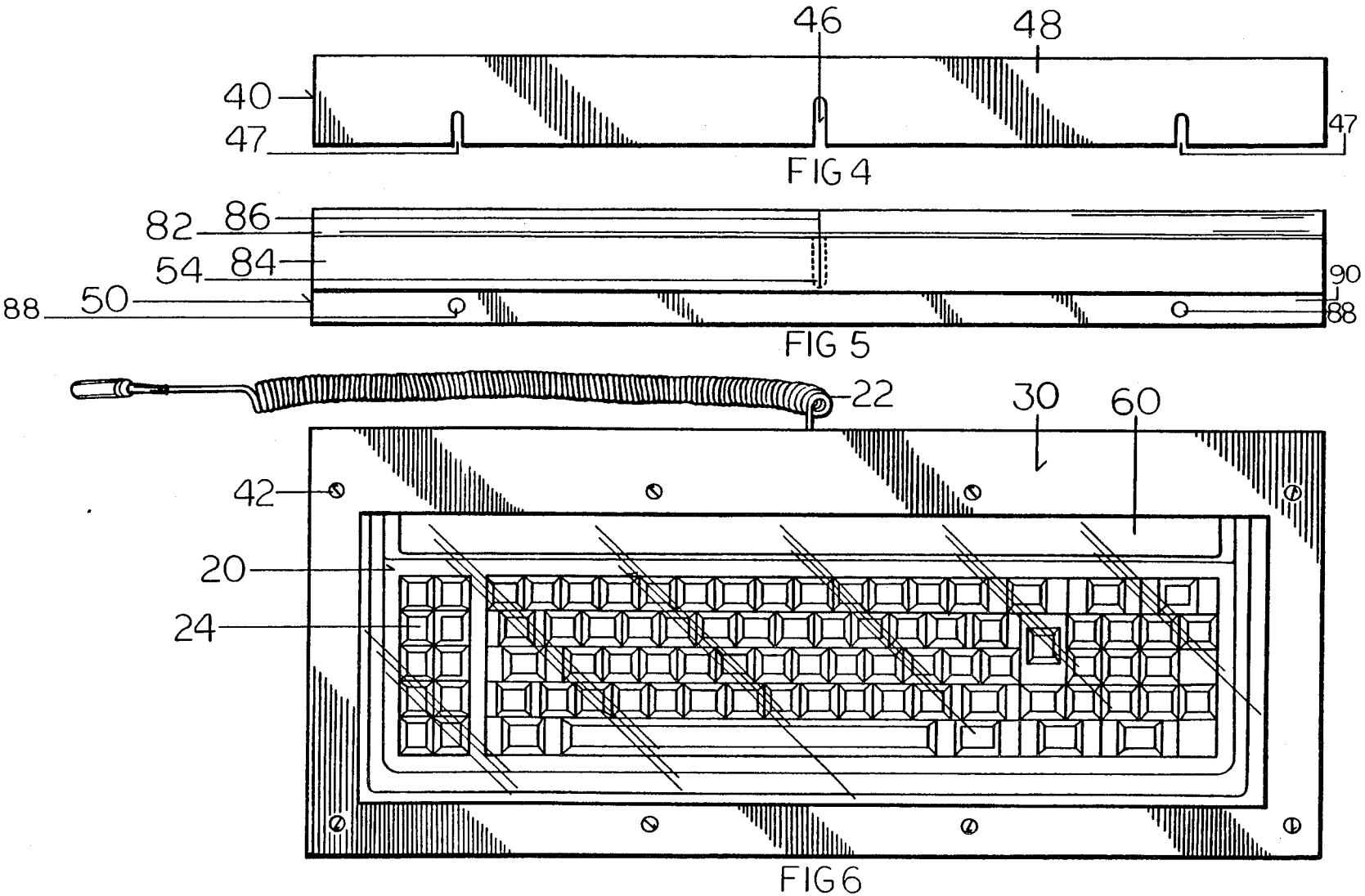
FIG. 4 is a rear elevation view of the upper section of the enclosure.
FIG. 5 is a rear elevation view of the lower section of the enclosure.
FIG. 6 is a top view of a protective keyboard enclosure assembly containing an electronic keyboard.

Lower section of enclosure assembly 50 shown in FIG. 5 has slot 54 located on rear surface 90 which allows cable 22 to exit therefrom while electronic keyboard 20 is enclosed in protective keyboard enclosure assembly 30. Both slot 46 and slot 54 are located on the center line of protective keyboard enclosure assembly 30 and coordinate with each other to allow cable 22 to enter and exit protective keyboard enclosure assembly 30. Seal 80 is slit at seam 86 also located on the center line of protective keyboard enclosure assembly 30 allowing cable 22 to exit protective keyboard enclosure assembly 30 and seal same from the harsh industrial atmosphere. Surface 90 has punched therein round holes 88 for extension therethrough fasteners 44, see FIG. 5 and FIG. 3.

FIG. 6 depicts protective keyboard enclosure assembly 30 as an operator will view it. Said operator will press keys 24 of electronic keyboard 20 through transparent, flexible membrane 60 which is mounted and held in place by use of fasteners 42 and clamp ring 70 not shown but previously described.

In accordance with the provisions of the Patent Statutes, we have explained the principle and operation of our invention and have illustrated and described what we consider to represent the best embodiment thereof.

We claim:

1. A keyboard enclosure assembly for protection of a keyboard connected to a system including computer, display monitor, and related equipment, comprising:

an upper section of enclosure assembly having a thickness with top and underside surfaces and an opening extending through said thickness from said top to said underside surface, said top surface being constructed such that said opening forms a viewing window and having sidewalls extending from said underside surface;

a lower section of enclosure assembly having a thickness with top and underside surfaces suitable for holding said keyboard at rest on said top surface and having sidewalls extending from said top surface such that said upper section of enclosure assembly may be mounted over said lower section of enclosure assembly;

a transparent, flexible membrane positioned in said opening of said upper section of enclosure assembly permitting an operator to view and press keys located in said keyboard;

a holding means for securing said transparent, flexible membrane to said upper section of enclosure assembly;

a sealing means between said upper section of enclosure assembly and said lower section of enclosure assembly;

a first fastening means for securing said transparent, flexible membrane between said holding means and said upper section of enclosure assembly;

a second fastening means for securing said upper section of enclosure assembly to said lower section of enclosure assembly.

2. A keyboard enclosure assembly according to claim 1, wherein said upper section of enclosure assembly has therein a plurality of apertures for receiving said first fastening means.

3. A keyboard enclosure assembly according to claim 1, wherein said sidewalls of said upper section of enclosure assembly are shaped to give said upper section of enclosure assembly a wedge shape as viewed from either end sidewall and wherein a rear sidewall has a first center line slot for receiving a cable.

4. A keyboard enclosure assembly according to claim 3, wherein said rear sidewall of said upper section of enclosure assembly has a plurality of slots for receiving said second fastening means.

5. A keyboard enclosure assembly according to claim 1, wherein said sidewalls of said lower section of enclosure assembly are shaped to give said lower section of enclosure assembly a wedge shape conforming to said upper section of enclosure assembly as viewed from either end sidewall and wherein a rear sidewall of said lower section of enclosure assembly has second center line slot for receiving said cable and coordinating with first center line slot of said upper section of enclosure assembly.

6. A keyboard enclosure assembly according to claim 5, wherein said rear sidewall of said lower section of enclosure assembly has therein a plurality of apertures coordinating to said plurality of slots of said upper section of enclosure assembly for receiving said second fastening means.

7. A keyboard enclosure assembly according to claim 1, wherein said holding means consists of a clamp ring having a thickness with clamp ring top and underside surfaces and clamp ring opening extending through said thickness from said clamp ring top surface to said clamp ring underside surface, said clamp ring opening conforming in dimension and shape to said opening in said upper section of enclosure assembly and being located such that said clamp ring top surface secures said transparent, flexible membrane to said under side surface of said upper section of enclosure assembly.

8. A keyboard enclosure assembly according to claim 1, wherein said sealing means consists of a gasket attached to a perimeter of said sidewalls of said lower section of keyboard enclosure.

9. A keyboard enclosure assembly according to claim 8, wherein said gasket of said sealing means consists of an upper circular cross section tube attached to a lower U-shaped gasket and having therein a slit located where said first center line slot fits over said second center line slot for receiving said cable to said keyboard enclosure assembly.

* * * * *